United States Patent [19]

Graham

[11] Patent Number: 5,028,147

[45] Date of Patent: Jul. 2, 1991

[54] INTEGRATED CONTAINER FOR MEAT PRODUCTS

[75] Inventor: Mark S. Graham, Sioux Falls, S. Dak.

[73] Assignee: Bell Paper Company, Sioux Falls, S. Dak.

[21] Appl. No.: 236,190

[22] Filed: Aug. 25, 1988

[51] Int. Cl.[5] ..... B65D 33/02

[52] U.S. Cl. ..... 383/119; 206/45.33; 220/449; 220/462; 229/117.06

[58] Field of Search ..... 229/117.06; 220/403, 220/460, 461, 449, 462, 416, 418; 383/119; 206/45.33

[56] References Cited

U.S. PATENT DOCUMENTS

| | | | |
|---|---|---|---|
| 248,179 | 9/1883 | Buckingham | 229/117.06 |
| 2,678,768 | 5/1954 | Vergobbi | 383/119 |
| 2,766,926 | 10/1956 | Thompson | 383/119 |
| 2,801,577 | 8/1957 | Ingham | 220/460 |
| 2,817,474 | 12/1957 | Abramson | 383/119 |
| 2,937,744 | 5/1960 | Olson | 220/461 |
| 3,945,561 | 3/1976 | Strebelle | 229/117.06 |
| 4,064,302 | 12/1977 | Kozlowski et al. | 220/461 |
| 4,115,909 | 9/1978 | Corella | 383/119 |
| 4,512,463 | 4/1985 | Ward | 220/461 |
| 4,622,693 | 11/1986 | Mykleby | 383/119 |

FOREIGN PATENT DOCUMENTS

| | | | |
|---|---|---|---|
| 651804 | 4/1951 | United Kingdom | 383/119 |
| 1558181 | 12/1979 | United Kingdom | 220/461 |

*Primary Examiner*—Gary E. Elkins
*Attorney, Agent, or Firm*—Gipple & Hale

[57] ABSTRACT

The invention is an integrated container structure in which a sealable envelope of flexible material such as plastic, has disposed within it a carton of semi-rigid material which is bonded to the interior of the envelope at one or more places. The carton consists of a sheet of carton material having appropriate fold lines and configuration to be erected or collapsed into a generally flat structure within the envelope. The invention is particularly useful for the shipment of animal products containing bones and has the advantages that it can be stored in a flat configuration and easily erected into an upright carton within the envelope by simple manipulative procedures.

4 Claims, 1 Drawing Sheet

INTEGRATED CONTAINER FOR MEAT PRODUCTS

SUMMARY OF THE INVENTION

The present invention is concerned with an integrated, air-tight container for shipment of goods, which is essentially a pre-formed and joined erectable carton disposed within and adhered to the interior of an air-tight envelope or bag of flexible material so that the container can be stored in a flat configuration and the carton erected for use within the evelope. The carton comprises a sheet of carton material having a rectangular base and a plurality of side and end panels which partially overlap and are joined to adjacent panels to form the side enclosure of the carton with appropriate hinge lines to permit erection of the carton within the enclosing envelope. The present invention is especially adapted for shipment of bones and animal products containing bones under vaccum.

BACKGROUND OF THE INVENTION

The shipment of animal products containing bones poses a unique problem which requires specialized packaging devices and techniques. It is first of all desirable to ship the animal products in inexpensive, air-tight containers to avoid the dissemination of odors or contamination. Plastic bags are one ideal form of containment in most respects since the plastic is air-tight and can be easily sealed. Further, plastic bags are relatively inexpensive and easy to handle and store. Unfortunately, the bones contained in animal products themselves are often sharp and capable of rupturing a plastic bag. For this reason, it is frequently the practice to place the animal products in a receptacle having semi-rigid and less easily penetrated walls such as a cardboard carton. It has, according, become the practice to ship these products in containers known as "bone shields" which are essentially cardboard cartons that are placed within a larger enclosing plastic bag. Since large numbers of these enclosures must be frequently used, it is obviously desirable to be able to store them in a compact manner. At the same time, it is equally desirable that the bags and boxes form an integrated, easily assembled and erected unit so that valuable time is not lost in erecting and preparing each bone shield for use.

It has been suggested in the prior art to provide sealable plastic bags having contained therein disassembled cartons which require extensive assembling before they are erected and ready for use. It is also known to provide previously erected, ready to use cartons which can be inserted into plastic envelopes of suitable size, but these units are difficult and bulky to store.

It is accordingly, an object of the present invention to provide a pre-formed collapsible bone shield which is contained within an enveloping plastic bag. It is another object of the present invention to provide a bone shield system which prevents bones from penetrating and rupturing the enclosing air-tight or vaccum sealed bag. It is a further object of the present invention to provide an easily erectable bone shield system for the shipment of animal products containing bones which can be stored in a collapsed, flat configuration, but which can be erected for use by simple manual manipulation of the pre-formed and bonded structure within the enclosing bag.

DETAILED DESCRIPTION OF THE INVENTION AND ACCOMPANYING DRAWINGS

The present invention is directed to a unique, integrated container for shipment of goods such as bones or meat products containing bones under reduced pressure or air-tight conditions which comprises an air-tight envelope of flexible material such as plastic, which is capable of sustaining a vaccum and a collapsible, but otherwise assembled and bonded carton disposed within the envelope and bonded to the interior of the envelope to form a unitary structure. The carton contained within the air-tight envelope comprises a sheet of carton material having a plurality of panel members which constitute the side walls of the carton with a part of each of the panel members overlapping a portion of the panels adjacent to it when folded and joined together to form the sides of the carton. Appropriate fold lines are provided both on the central base member and the panels to permit collapsing of the carton structure into a flat configuration without removing or detaching it from the enclosing flexible envelope to which it is attached and to permit easy erection of the carton structure into an open carton suitable for receiving and transporting the animal products. The present invention thereby provides distinct advantages over devices of the prior art by being adapted to be stored as a single integrated unit in a flat configuration while at the same time, being easily unfolded into an erect, box-like configuration by simple manipulative procedures without the need for joining or bonding the respective elements of the carton structure or removing or detaching the carton structure from the enclosing envelope.

The advantages and structure of the present invention will, however, be more completely appreciated by having specific reference to a preferred embodiment thereof illustrated and described herein.

Figure 1:
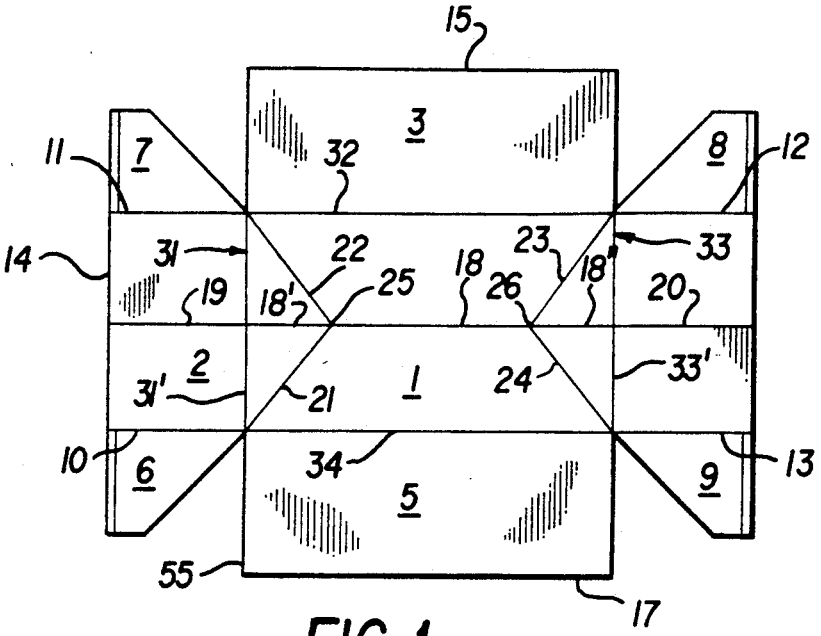
FIG. 1 is a plan view of the unfolded and unbonded blank used to form the erectable carton of the present invention.

Directing attention to FIG. 1 of the drawings, a precut sheet of cardboard or other semi-rigid material having a rectangular base 1 is shown. To each side or edge 31 to 34 of the base 1, a lateral panel 2 to 5 respectively, is hinged. The base and lateral panels are together symetrical in relation to one of the center lines of the base preferably the longest center line 18. The lateral panels 2 and 4 take the form of isosceles trapezia where the receptable has a rectangualr base. In the illustrated embodiment, the two end lateral panels 2 and 4, corresponding to the short edges 31 and 33 of the base 1, have crease lines 10, 11 and 12 13, respectively, to enable these end panels 2 and 4 to be folded and joined, for example, by adhesive to the two other lateral side panels 3 and 5, flaps 6 to 9 intended to be joined to the panels 3 and 5. The flaps 6 to 9 must, of course, be shaped in such a way that they do not extend beyond the lateral panels 3 and 5 when they are folded onto them during assembly.

According to the present invention, in view of the the desired flat packing of the assembled package within the enclosing air-tight envelope, the sheet blank illustrated in FIG. 1 of the drawings includes a number of pre-folded lines. A first fold line runs along the symetrical crease which constitutes the main center line 18, of the base 1, and its extensions 19 and 20 on the two small end panels 2 and 4. This fold line 18 intersects each short side or edge 31 and 33 of the base dividing that side or edge in half. The blank further contains a number secondary fold lines, 21 to 24 diagonally extending between each apex or corner of the base and intermediate points 25 and 26 on the first fold line. As shown in FIG. 1, these diagonal fold lines are extensions of the interior bi-sector angles, each formed by two joining edges of two neighboring lateral panels, when the latter are folded down along the plane of the base, i.e., when the receptable is in its flat blank state. Diagonal lines 21 and 22 as shown intersect the center line 18 at a point 25 on line 18. Similarly, the secondary, diagonal fold lines 23 and 24 intersect this center line 18 at a point 26 on the latter line. The edges 10 and 55 are angularly spaced apart when the sheet for the receptacle is in its flat blank state, prior to setting up the receptacle, as shown in FIG. 1, and are combined to become one and the same when the receptacle is assembled.

Figure 2:
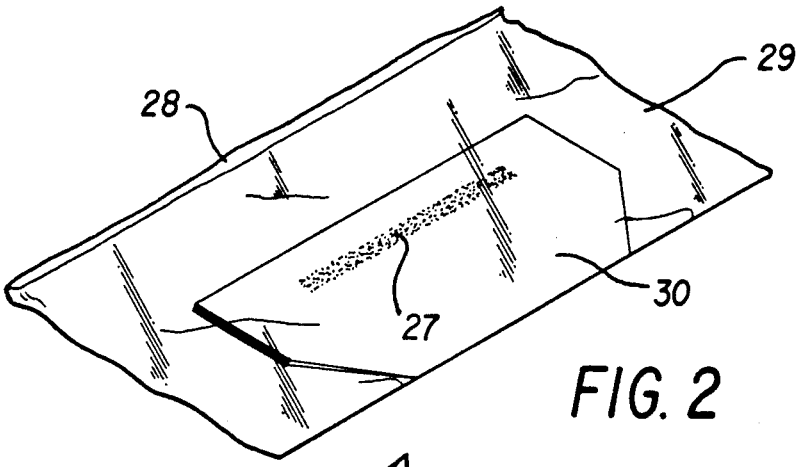
FIG. 2 is a perspective view of the assembled, but collapsed flat carton of the invention within an enclosing plastic bag.
Figure 3:
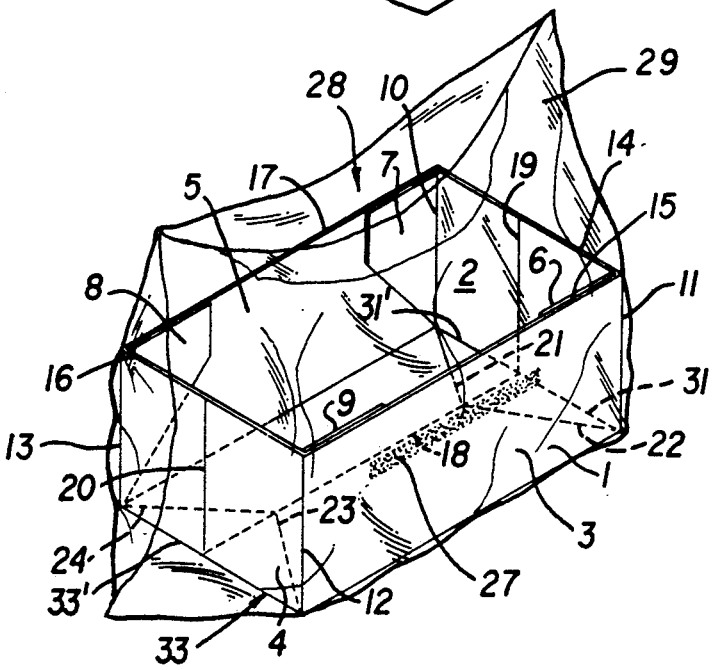
FIG. 3 is a perspective view of the erected carton of the present invention within the enclosing plastic bag.

The assembled and bonded carton can be flattened or collapsed as shown in FIG. 2 of the drawings, and can be folded or set up within its enclosing envelope as shown in FIG. 3 of the drawings. To collapse the carton, the end panels 2 and 4 are respectively folded along lines 19, 18, and 20, 18" towards the inside of the box. This operation makes the base 1 close outward upon itself. Erecting of the carton from its flat configuration is easily and quickly accomplished, essentially by applying outward pressure to the fold lines 19, 20 31, 31" 33, 33" and then creasing the intersection of the panels 3 and 5 with the base member 1 along lines 32 and 34 respectively. The erection procedure for collapsing the already erected structure, is easily accomplished within the enclosing plastic envelope requires no additional bonding of the respective parts of the pre-formed blank.

The carton structure is adhered to the interior of the flexible, air-tight pouch or envelope by means of a suitable adhesive applied to panels 3 and 5. This adhesive maintains the carton in the correct position within the enclosing envelope so that it is ready upon erection to receive its intended contents. Final closure of the system is conveniently achieved by heat sealing the opening 28 of the plastic bag 29 as illustrated in FIG. 2 of the drawings.

The carton of the present invention is conveniently made of flexible pasteboard having sufficient strength to substantially prevent penetration by bones carried within the carton. It is also convenient to coat one or both sides of the cardboard material with a moisture impervious material to prevent the cardboard from soaking up or adhering to fluids released by the bones or attached meat. The enclosing envelope is typically made of a suitable polymeric material such as polyethylene.

While a preferred embodiment of the present invention has been described herein for illustrative purposes, it will be apparent to those of ordinary skill in the art that the scope of the present invention is considered to include other embodiments and alternatives.

I claim:

1. A container for shipment of goods under reduced pressure comprising in combination: an air tight envelope of flexible material capable of sustaining a vacuum and a collapsible carton disposed therein and adapted to be erected or collapsed within said envelope, said carton comprising a sheet of carton material having a plurality of panel members disposed as outer parts of the sheet, a part of each of said panel members overlapping a portion of the adjacent panel members when folded and being joined thereto to form the sides of said carton; a rectangular base member constituting a central part of the sheet; a system of hinge lines, each defining a side of one of the panel members and a side of the base member coincident with the panel side to permit folding the panel members about the hinge lines for erecting or collapsing said carton; and a system of fold lines extending over surfaces of said base member and several of said panel members, said system including a primary fold line coincident with the center line of the sheet to permit convex folding of said base members, and a number of secondary fold lines extending into the base member, one of said secondary fold lines being between each corner of the base member and a point on the first fold line diagonally spaced from the respective corner, said system of fold lines permitting collapsing the erected carton into a flat unit and erecting of said collapsed unit into an erect carton within said envelope.

2. The container structure of claim 1 wherein at least one surface of said carton is coated with a moisture resistant material.

3. The container structure of claim 1 wherein said envelope is air-tight when sealed.

4. The container of claim 1 wherein said envelope is made of plastic and said carton is made of cardboard.

* * * * *